United States Patent [19]

Morse

[11] Patent Number: 4,826,171

[45] Date of Patent: May 2, 1989

[54] PUZZLE

[76] Inventor: Henry S. Morse, 4046 Championship Dr., Annandale, Va. 22003

[21] Appl. No.: 181,176

[22] Filed: Apr. 13, 1988

[51] Int. Cl.[4] ..... A63F 9/12

[52] U.S. Cl. ..... 273/160

[58] Field of Search ..... 273/156, 157 R, 160

[56] References Cited

U.S. PATENT DOCUMENTS 1,886,109 11/1932 Lenfant ..... 273/160 X 2,610,856 9/1952 Welty ..... 273/160

FOREIGN PATENT DOCUMENTS 604792 9/1978 Switzerland ..... 273/160

*Primary Examiner*—Anton O. Oechsle

*Attorney, Agent, or Firm*—Richard C. Litman

[57] ABSTRACT

A puzzle includes four ring members and a center solid circular member, all having a plurality of radially extended, asymmetrically disposed segments, wherein after proper manipulation of the several ring members and proper alignment of the radially extended segments, a composite geometric puzzle is provided. All members include two layers with the bottom layer providing a concentric solid mass upon completion of the puzzle while the top layer comprises radially extended segments which can also all be disposed within a single layer after proper angular alignment. The segments are arcuately spaced on each member and extend flush with the circumference of the outermost ring.

7 Claims, 2 Drawing Sheets

PUZZLE

BACKGROUND OF INVENTION

It is well known that amusement devices such as puzzles provide entertainment while cultivating patience and skill, as well as challenging the mind and memory of the user in trying to find a predetermined solution.

The invention relates to an amusement device, and more particularly, the invention is directed to an improved construction of a puzzle of the put-together and take-apart type.

The invention further relates to a puzzle which is compact and simple in construction, but which provides real challenge to the user. The invention is easily comprehended by children and adults alike, and the method of construction of the device is more fully described herein.

DESCRIPTION OF THE PRIOR ART

Various prior art amusement devices, puzzles and the like as well as their apparatuses and their methods of construction in general, are known and found to be exemplary of the U.S. prior art. Existing take-apart and put-together puzzles of this type have distinctively configured puzzle pieces designed to be interfitted into one or more planes. In this respect, U.S. Pat. No. 1,050,141, issued Jan. 14, 1913, to San S. Joy, illustrates a puzzle and ornamental device comprising a pair of flat disks formed of a plurality of circular sections which permits a ball to be enclosed in the recess formed by the interfitted flat disks.

There are also found inter-engaging ring puzzles having several split rings with grooves adapted to be assembled into coplanar arrays, as illustrated in U.S. Pat. Nos. 2,241,490, issued Mar. 30, 1939 to Irving Steinhardt, and U.S. Pat. No. 3,970,314, issued July 20, 1976 to Gert Michael Mayr et al.

These patents or known prior uses teach and disclose various types of puzzles or sorts and various manufactures, and the like, as well as their methods of construction; but none of them, whether taken singly or in combination, disclose the specific details of the combination of the invention in such a way as to bear upon the claims of the present invention.

SUMMARY OF THE INVENTION

The general purpose of the present invention is to provide a puzzle comprising four ring members and a center solid circular member, each member having radially extended segments which are attached to the upper surface of the ring members. The ring members fit concentrically within one another with minimal clearance. When these ring members are oriented in the solution position, the radially extending segments fit next to one another with no overlap. The four ring members include four radially extending segments each while the innermost solid circular member contains three radially extending segments.

Each member is in the form of a ring or solid circular section including radially extending segments; and may be made of any suitable material such as wood. As persons in the art will appreciate other materials may be provided in the invention. These ring shaped members are preferably concentrically circular in shape but may vary in size. Each ring member is defined by an arcuate peripheral rim of suitable thickness and width. The rim of each ring member is provided with a plurality of radially extended segments positioned so that the segments extend outwardly to the peripheral rim of the outermost ring member. The radially extending segments are attached to the upper surface of the ring members, while the center solid circular member is a one piece construction having radially extended segments extending from the side of the center solid member.

A solution is achieved when the radially extending segments are interfitted to provide a substantially continuous surface in the top plane. The rings will interfit to form a substantially continuous surface in the lower plane when this solution is achieved.

One object, advantage and feature of this invention is to provide an interesting and intricate puzzle designed to afford amusement and entertainment.

Another object of the invention is to provide a puzzle which comprises a plurality of movable pieces of various shapes and sizes while challenging the mind and the memory.

A further object of the invention is to provide a puzzle wherein the solution of the puzzle depends upon the proper alignment of the puzzle pieces.

Yet another object of the invention is to provide a puzzle of the construction described which is easily constructed of readily available materials.

These, together with other objects and advantages of the invention reside in the details of the process and the operation thereof, as is more fully hereinafter described and claimed. References are made to the drawings forming a part hereof, wherein like numerals refer to like parts throughout.

DESCRIPTION OF PREFERRED EMBODIMENT

Figure 1:
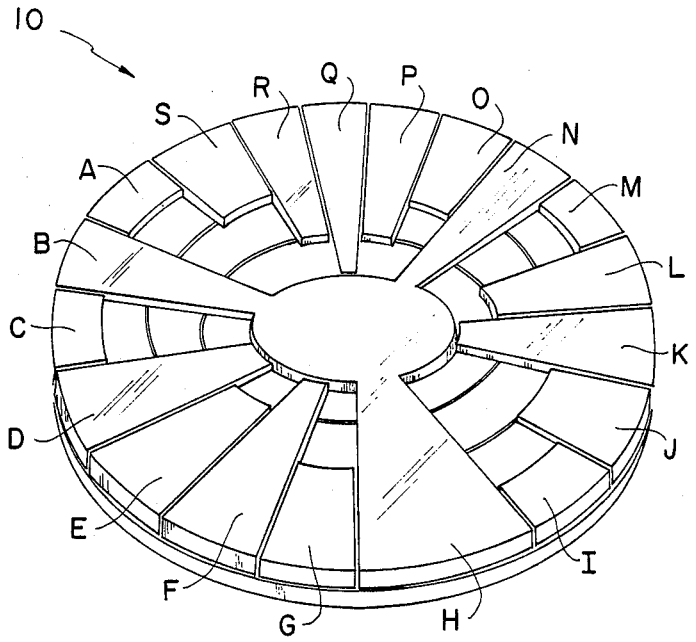
FIG. 1 is perspective top view of the composite puzzle.

Reference is now made to the drawings, and in particular to FIG. 1 wherein there is illustrated, in perspective, a preferred embodiment of a puzzle forming the present invention and generally designated by the numeral 10. In this respect the puzzle 10 includes four ring members 1,2,3,4 and a solid circular center member 5. Each member will be seen to include a plurality of angularly spaced apart segments designated by the letters A through S, while those segments on the ring members 2,3,4 and the center member 5 radially extend beyond the outer periphery of the respective members. In FIG. 1, the puzzle is shown fully assembled in the only solution configuration.

Figure 2:
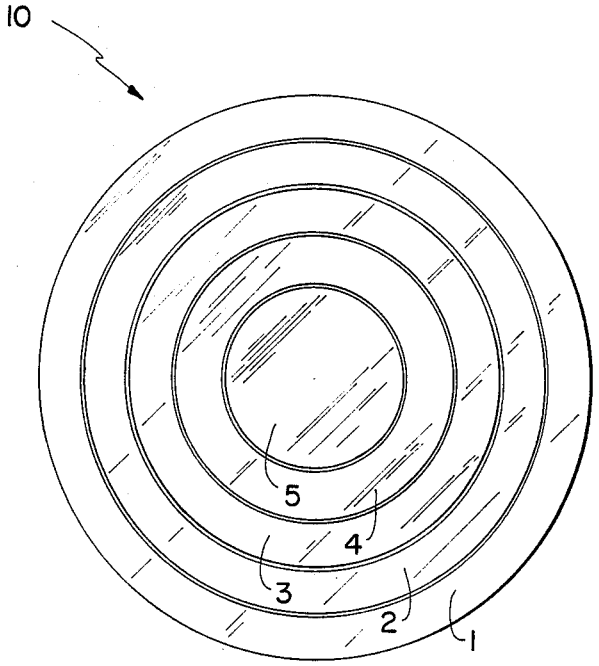
FIG. 2 is a bottom plan view of the composite puzzle.

As shown in FIG. 2 the five ring members and the solid circular center member are provided with lower surfaces which, when concentrically arranged, form a coplanar lower surface of the puzzle. All members are interfitted with minimal clearance between the members, therefore a composite geometric puzzle is provided.

Figure 3:
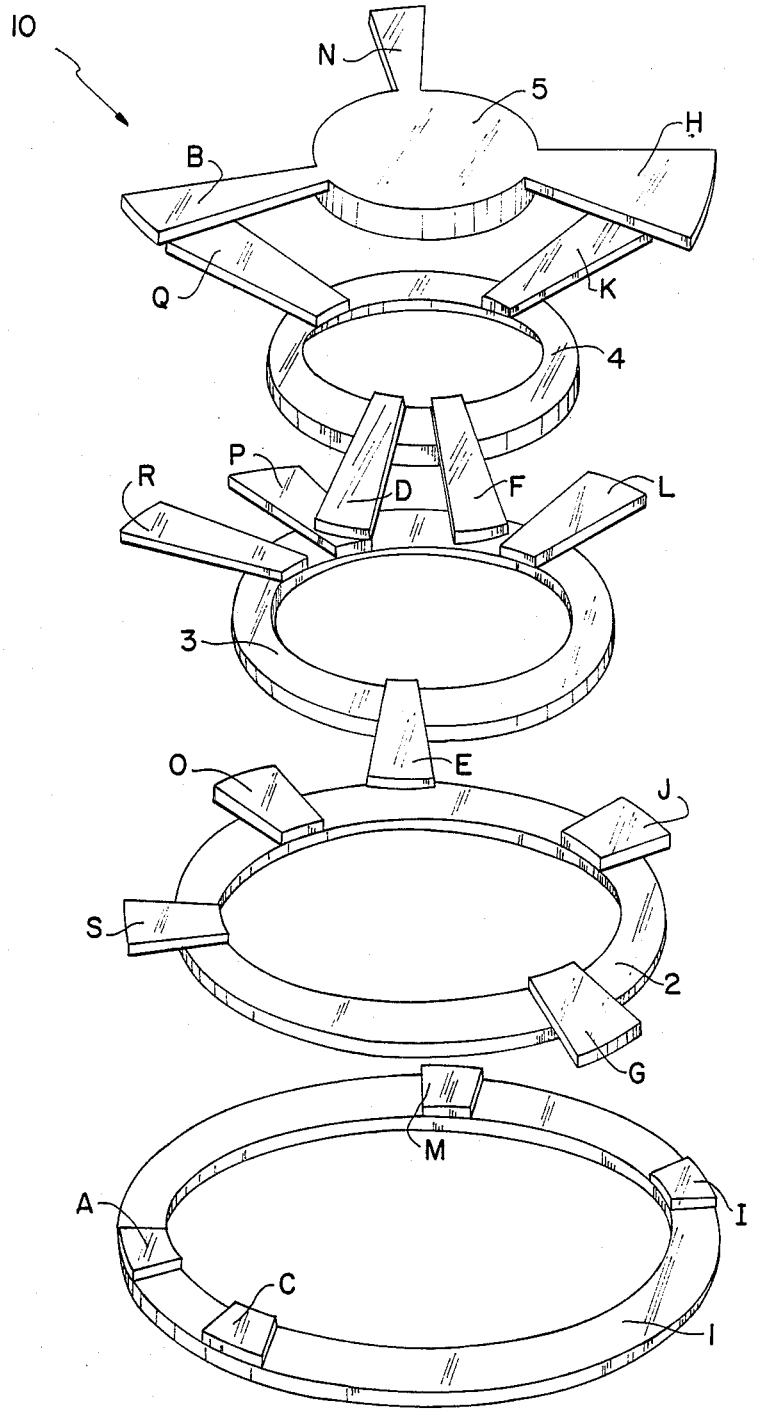
FIG. 3 is an exploded perspective view of the puzzle pieces.

FIG. 3 shows the puzzle pieces in exploded view, and illustrates the spatial interrelationships of the pieces to form a solution. In attempting to solve the puzzle, the user often begins by placing the outer ring 1 on a flat surface. Then the user will insert ring 2 in a position which allows the extensions S, O, I, and G to fit so as not to interfere with extensions A, M, C, and I. The user will then repeat this process with rings 3, 4, and 5. In most cases, the user will be unable to complete the puzzle, because at some point two or more of the radially extending segments will overlap one another.

To accomplish the only solution, place the outermost ring member 1 on a flat surface and interfit ring member 2 inside ring member 1 so that segment S on ring member 2 lies flush with the inside edge of segment A on ring member 1, and so that segment J lies flush with segment I on ring member 1.

Next, place ring member 3 into ring member 2 so that segment R lies flush with segment S, segment P lies flush with segment O and segment L flies flush with segment M.

Next, place ring member 4 into ring member 3 so that segment Q lies flush between segments P and R, segment K lies between L and J and segments D and F lie on each side of segment E on ring member 3.

Finally, by mainpulating the center solid circular member 5 so that segment N lies flush between segments O and M, segment B lies between A and C, and segment H lies between segments G and H, and composite geometric puzzle is completed. All segments extend to the peripheral edge of the outermost ring member, and are interfitted with a minimal clearance between the members.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to fall within the scope of the invention.

I claim:

1. A puzzle of the take-apart and put-together type comprising, a plurality of interfitting ring members of varying diameters and a center member. said members having upper and lower layers, said upper layers on said ring members including a plurality of superimposed and angularly spaced apart segments, said segments on at least certain of said ring members radially extending therefrom, whereby said segments are adapted to be disposed in a laterally adjacent interfitting relation when said ring members are properly radially oriented.

2. The puzzle of claim 1 wherein said members when disposed in an interfitting relation are concentric.

3. The puzzle of claim 1 wherein said members when disposed in an interfitting relation provide minimal clearance therebetween.

4. The puzzle of claim 1 wherein said center member includes a solid circular disk.

5. The puzzle of claim 1 wherein said center member lower layer comprises a solid circular disk.

6. The puzzle of claim 1 wherein said segments on any said ring member are symmetrically disposed relative to each other.

7. The puzzle of claim 1 wherein said center member upper layer includes a plurality of segments extending radially therefrom.

* * * * *